US005695575A

United States Patent [19]

Angevaare et al.

[11] Patent Number: 5,695,575

[45] Date of Patent: Dec. 9, 1997

[54] ANTI-FORM SYSTEM BASED ON HYDROCARBON POLYMERS AND HYDROPHOBIC PARTICULATE SOLIDS

[75] Inventors: Petrus Adrianus Angevaare, Ho-Ho-Kus, N.J.; Olaf Beers, Delft, Netherlands; Peter Robert Garrett, Pantymwyn, Wales; Alla Tartakovsky, W. Orange, N.J.; John William Harold Yorke, South Wirral, England

[73] Assignee: Lever Brothers Company, Division of Conopco, Inc., New York, N.Y.

[21] Appl. No.: 540,285

[22] Filed: Oct. 6, 1995

[51] Int. Cl.[6] ..... B08B 9/20; B08B 3/00

[52] U.S. Cl. ..... 134/25.2; 134/29; 252/321; 252/358; 510/226; 510/229; 510/230; 510/475

[58] Field of Search ..... 134/25.2, 29; 252/321, 252/358; 510/226, 229, 230, 475

[56] References Cited

U.S. PATENT DOCUMENTS

| | | | |
|---|---|---|---|
| 3,235,509 | 2/1966 | Nitzsche et al. | 252/358 |
| 3,909,445 | 9/1975 | Ernst | 252/321 |
| 4,087,398 | 5/1978 | Heyden et al. | 260/29.6 R |
| 4,692,267 | 9/1987 | Fock et al. | 252/321 |
| 4,818,292 | 4/1989 | Iley et al. | 106/210 |
| 4,937,011 | 6/1990 | Schmid et al. | 252/99 |
| 5,200,236 | 4/1993 | Lang et al. | 427/213 |
| 5,229,027 | 7/1993 | Ahmed | 252/99 |
| 5,366,654 | 11/1994 | Van Den Brom et al. | 252/174.17 |
| 5,374,369 | 12/1994 | Angevaare et al. | 510/220 |
| 5,376,301 | 12/1994 | Fleuren et al. | 510/278 |
| 5,468,410 | 11/1995 | Angevaare et al. | 510/220 |
| 5,480,576 | 1/1996 | Gary et al. | 510/220 |

FOREIGN PATENT DOCUMENTS

| | | |
|---|---|---|
| 517 314 | 12/1992 | European Pat. Off. . |
| 554943 | 8/1993 | European Pat. Off. . |
| 14 67 613 | 5/1974 | Germany . |

OTHER PUBLICATIONS

P.R. Garrett, "The Mode of Action of Antifoams" in Defoaming Theory and Industrial Applications, Surface Science Series, vol. 45, 1993.

*Primary Examiner*—Arlen Soderquist
*Attorney, Agent, or Firm*—A. Kate Huffman

[57] ABSTRACT

A method and composition for inhibiting foam formation in automatic dishwashers are described. The composition comprises an anti-foam system having 0.01 to 1% of certain hydrophobic particulate solids combined with 0.01 to 4% of high viscosity hydrocarbon polymers; 1 to 30 wt. % of a bleaching agent; 1 to 40 wt. % of a surfactant; 0.1 to 10 wt. % of an enzyme; and 1 to 75 wt. % of a builder, the composition having a pH of less than about 11.

20 Claims, No Drawings

ANTI-FORM SYSTEM BASED ON HYDROCARBON POLYMERS AND HYDROPHOBIC PARTICULATE SOLIDS

FIELD OF THE INVENTION

This invention relates to an anti-foam system based on the combination of hydrocarbon polymers and hydrophobic particulate solids in an automatic dishwashing detergent composition to provide improved cleaning and low foaming performance.

BACKGROUND OF THE INVENTION

Detergent compositions for automatic dishwashers have become increasingly milder and less alkaline than earlier prior art products. Such compositions have a safer and more environmentally friendly profile because the compositions are formulated without chlorine bleach and are free of phosphates. To avoid compromising cleaning performance, however, enzymes are increasingly included in the formulations to remove proteinaceous and starchy soils.

It has been observed that proteolytic enzymes combined with selected surfactants and incorporated in liquid machine dishwashing compositions provide a synergistic improvement in the removal of proteinaceous soil. See, e.g. EP 554 943 (Unilever) published on Aug. 11, 1993. Although such systems exhibit improved cleaning, the presence of the surfactant generates foam in the machine. Since foam can cause air to be drawn into the water circulating pump of the dishwashing machine, it reduces the mechanical impact of the detergent solution sprayed onto the dishware. As a result, foaming ultimately compromises cleaning performance.

Effective anti-foam agents for automatic dishwashing compositions are known in the art such as long-chain ketones described in U.S. Pat. No. 4,937,011 (Henkel) and U.S. Pat. No. 4,087,398 (Henkel). The long-chain ketones are generally dispersed in a hydrocarbon carrier and constitute the solid particle fraction. Although the ketone/carrier anti-foam systems are effective in inhibiting foam caused by food residues in dishwashing machines in which the compositions are used, the compositions do not contain a surfactant. Additionally, the ketone/carrier anti-foam works effectively at the beginning of the washing cycle, but disproportionation of the carrier droplets in which the ketones reside is believed to occur as the cycle continues, leading to diminished anti-foam effectiveness in the latter portion of the wash.

Applicants have discovered that the use of an anti-foam system which combines a high viscosity hydrocarbon polymer with particular hydrophobic particulate solid materials, such as long chain ketones provides a synergistic improvement over the use of the individual components and further provides an effective anti-foam system for automatic dishwashing detergents.

Although certain hydrophobic particulate solids, such as long-chain ketones, are known in the art as effective anti-foam components, there is no teaching that such materials when combined with certain hydrocarbon polymers will provide an improved anti-foam system (see EP 517 314 Colgate Palmolive Company).

In DE 14 67 613 long-chain ketones were described as foam inhibitors in soap containing detergents for fabric washing. The combination of such ketones with high viscosity hydrocarbon polymers was not suggested. Additionally, fabric washing machines are much more tolerant of foaming than dishwashers, primarily because of the much lower agitation compared to that caused by the spray-arms in the automatic dishwashers. Another important factor is that generally higher amounts of foam producing proteinaceous soils are present in dishwashers. Therefore, the compositions taught in the German publication included high foaming surfactants and anionic components which would not be tolerated in an automatic dishwashing machine.

It is thus an object of the present invention to provide an anti-foam system including a certain high viscosity hydrocarbon polymers and certain hydrophobic particulate solids in a ratio of from about 10:1 to 1:20, more preferably a ratio of from about 5:1 to 1:10, hydrophobic particulate to polymer, which may be incorporated into an automatic dishwashing composition.

Another object of the invention is to provide compositions for a dishwasher which comprise enzymes with selected surfactants and which have a pH less than about 11 to provide a low foaming, highly effective cleaning composition which performs consistently throughout the dishwashing cycle.

More particularly, hydrophobic particulates such as long-chain ketones having at least 25 carbon atoms, certain insoluble salts and certain hydrophobically modified inorganic oxides, combined with high viscosity hydrocarbon polymers are described which provide an effective anti-foam system for use in surfactant-containing low alkalinity dishwashing compositions.

A method of washing tableware in an automatic dishwashing machine with a low alkalinity detergent composition which provides effective cleaning without foam formation is also described.

SUMMARY OF THE INVENTION

An automatic dishwashing detergent composition is described which comprises:

a) an anti-foam system comprising (i) 0.01 to 1% by wt. of the total composition of hydrophobic particulate solid material selected from the group consisting of a ketone having at least 25 carbon atoms, an ester of a fatty acid having $C_{12}$ to $C_{22}$ carbons and water-insoluble salts thereof, a water-insoluble salt of an alkylphosphate having from a $C_8$ to a $C_{22}$ straight or branched carbon chain, and a hydrophobically modified inorganic oxide, and (ii) 0.01 to 4% by wt. of the total composition of a hydrocarbon polymer having a viscosity of preferably higher than 500 mPa.s (as measured at a shear rate of 21 $s^{-1}$), the ratio of the hydrophobic particulate solid material to the hydrocarbon polymer being from 10:1 to 1:20; preferably from 5:1 to 1:5;

b) 0.5 to 40 wt. % of a surfactant selected from the group consisting of:

(i) an anionic surfactant with a hydrophilic head group which is, or which contains a sulfate or sulfonate group and a hydrophobic portion which is or which contains an alkyl or alkenyl group of 6 to 24 carbon atoms, (ii) an alkyl glycoside, (iii) an ethoxylated fatty alcohol of formula $$RO(CH_2CH_2O)_nM$$

wherein R is an alkyl group of 6 to 16 carbon atoms and n has an average value which is at least four and is sufficiently high that the HLB of the ethoxylated fatty alcohol is 10.5 or greater;

c) 0.1 to 10 wt. % of an enzyme;

d) 1 to 30 wt. % of a bleaching agent selected from a group of a peroxygen agent, a hypohalite agent and its corresponding salts and mixtures thereof; and e) 1 to 75 wt. % of a builder, wherein a 1% aqueous solution of the detergent composition has a pH of less than about 11.

A method of washing tableware in a dishwasher providing effective cleaning without foam formation is also described.

DETAILED DESCRIPTION OF THE PREFERRED EMBODIMENTS

Compositions of the invention may be in any form conventional in the art such as powder, tablet, liquid or gel. The compositions may also be produced by any conventional means.

Anti-foam System

The anti-foam system of the invention contains a hydrophobic particulate solid material combined with a high viscosity hydrocarbon polymer in a ratio of 10:1 to 1:20 hydrophobic particulate material to hydrocarbon polymer, preferably 5:1 to 1:10; most preferably 5:1 to 1:5. It was observed that these hydrophobic particulates, particularly the long chain ketones, worked effectively at the beginning of the wash cycle, but the anti-foam effectiveness diminished significantly towards the latter portion of the wash. By incorporating the highly viscous hydrocarbon polymers in the anti-foam system it was found that effective foam control throughout the wash could be achieved.

Hydrophobic Particulate Solid Materials

Hydrophobic particulates useful for the invention are specific finely divided particles with limited wettability in the foaming medium which destabilize foams and froths. For aqueous surfactant solutions, this means that selected finely divided particulates that are hydrophobic or rendered hydrophobic by surface treatment (generally causing contact angles >90° at the air-water surface, measured through water) and are insoluble or sparingly soluble in water, are useful for the invention. Geometry and size of the particles are important parameters with regard to effectiveness, as described by P. R. Garrett, "The Mode of Action of Anti-foams" in DEFOAMING Theory and Industrial Applications, Surface Science Series Vo. 45, 1993, and references therein. In general, small particles (<100 μm) and/or rough particles with many edges can give rise to rapid film collapse.

Hydrophobic particulates useful for the invention include:

(a) certain long chain ketones;

(b) esters of fatty acids having from $C_{12}$ to $C_{22}$ straight or branched carbon chains and the water-insoluble salts thereof;

(c) water-insoluble salts of alkylphosphates having from $C_8$ to $C_{22}$ straight or branched carbon chains; and (d) hydrophobically modified inorganic oxides.

(A) Long Chain Ketones

The long-chain ketones are prepared as described in U.S. Pat. No. 4,937,011 (Henkel), herein incorporated by reference. The ketones are prepared by catalytic elimination of $CO_2$ from higher monocarboxylic acids, more particularly relatively high molecular weight fatty acids or salts thereof.

Preferred ketones are those obtained by the reaction of linear or branched, saturated or unsaturated carboxylic acids or carboxylic acid mixtures in which the carboxylic acids or some of them contain more than 12 carbon atoms and in particular, have a carbon chain-link of $C_{14}$ to $C_{30}$ and, on ketonization, react with water with elimination of carbon dioxide. Particularly preferred ketones are those obtained by the ketonization of $C_{16}$–$C_{22}$ carboxylic acids or carboxylic acid salts and mixtures thereof as described in U.S. Pat. No. 4,937,011 (Henkel).

Mixtures of symmetrical and asymmetrical ketones are formed in which the asymmetrical ketones, commensurate with the material used, may have chain lengths other than $C_{14}$ or $C_{12}$ provided that a relatively long-chain radical is present in the molecule so that the total number of carbon atoms on average is at least about 25. Examples are heptacosanone-14, hentriacontanone-16, pentatriacontanone-18, nonatriacontanone-20, triatetracontanone-22 or nonacossanone-15, tritriacontanone-17, heptatriacontanone-19, hentetracontanone-21 and the like.

Ketones or ketone mixtures useful in the present invention are normally solid at room temperature and have melting points in the range from 60° to 105° C. To make them easier to process and to improve their foam-inhibiting effect, it is preferred to disperse the ketones in a liquid carrier. Suitable liquid phases are preferably organic carriers which have a low pour point or melting point of lower than about 5° C. The liquid carrier phase may also have a foam-inhibiting effect or may be used solely as a carrier for the foam inhibitor of the invention.

Particularly useful organic carrier liquids, which have an additional foam-inhibiting effect, are mineral oils having a boiling point above 140° C. and branched alcohols containing 8 to 24 carbon atoms, such as 2-hexyl-1-decanol or 2-octyl-2-dodecanol. Other useful foam-inhibiting carrier liquids are liquid esters of branched or unsaturated fatty acids containing 8 to 18 carbon atoms with monohydric or polyhydric alcohols, for example glycol diesters or glycerol triesters of oleic acid, isostearic acid; esters based on branched-chain or unsaturated, liquid fatty alcohols containing 8 to 18 carbon atoms, for example isotridecyl alcohol or oleyl alcohol. Mixtures of these carriers may also be used.

It is preferred to use organic carriers in which the ketones are soluble at elevated temperature and precipitate in finely divided form on cooling. To this end, the components are heated, a solution formed and then rapidly cooled with intensive stirring. Stable dispersions of finely divided foam inhibitors are formed. However, dispersions may also be prepared by stirring the finely ground, wax-like ketone or ketone mixture into the liquid phase.

The dispersions to be processed preferably contain about 5 to about 15% by weight of the ketone or mixtures of ketones. The ketones are present in the detergent composition in an amount of from 0.01 to 1%.

In addition, the dispersion of the ketone in the liquid carrier may be stabilized by suitable additives. Suitable additives are, for example, magnesium stearate, calcium stearate or aluminum stearate in quantities of from about 0.3 to 3.0% by weight.

A commercially available ketone of the type described above is available under the trade name Dehypon®2429 from Henkel.

As noted above, it was observed that the ketone/carrier anti-foam works effectively at the beginning of the washing cycle but that the anti-foam effectiveness can diminish significantly towards the latter portion of the wash. Disproportionation during the wash of the carrier droplets in which the ketones reside is believed to cause this effectiveness drop. Increasing the viscosity of the anti-foam system by incorporating highly viscous hydrocarbon polymers was found to produce more effective foam control at the end of the wash, probably by reducing droplet disproportionation.

(B) Esters of Fatty Acids and Their Corresponding Water-Insoluble Salts

The water-insoluble salts of the esters of long chain fatty acids are also useful in the invention. The fatty acid esters have a straight or branched $C_{12}$ to $C_{22}$, preferably $C_{16}$ to $C_{18}$ carbon chain in the acyl radical.

Suitable fatty acids are either saturated or unsaturated and can be derived from natural sources such as, for example, plant or animal esters (e.g., palm oil, coconut oil and fish oil) or can be synthetically prepared for example via the oxidation of petroleum. Preferred fatty acids include palmitic acid, palmitoleic acid, oleic acid, stearic acid, and linoleic acid. The water-insoluble salts of these fatty acids are preferably salts of polyvalent metals, such as calcium, magnesium, zinc, and aluminum, but can also be mixed salts of polyvalent metals and/or of lower dibasic amines, such as aluminum-magnesium stearate, zinc-ethylene diamine stearate. Esters of the above-mentioned fatty acids with $C_{1-3}$ alcohols are also suitable, such as ethyl stearate, methyl palmitate and glycerol mono stearate.

(C) Water-Insoluble Salts of Alkylphosphates

Water-insoluble salts of certain alkylphosphates are also useful. The alkylphosphates include straight or branched $C_8$ to $C_{22}$ carbon chains. Mixtures of these alkylphosphates may also be used. The water-insoluble salts of these alkylphosphates are preferably salts of polyvalent metals, such as calcium, magnesium, zinc and aluminum.

(D) Hydrophobically Modified Inorganic Oxides

Aluminum oxides, titanium dioxides, alkali metal or alkaline earth metal silicoaluminates, and particularly all manner of silicas can be hydrophobically modified as known in the art and are as such useful in the present compositions and processes. For example, hydrophobic silicas can be obtained by contacting silica, which can be a precipitated silica, a silica made by a gel formation technique, or preferably a fumed silica, with any of the following compounds: metal, ammonium and substituted ammonium salts of long chain fatty acids, such as sodium stearate and the like; silyl halides, such as ethyltrichlorosilane, tricyclohexylchlorosilane and the like; and long chain alkyl amines or ammonium salts, such as cetyl trimethyl amine, cetyl trimethyl ammonium chloride and the like. Alternatively, a hydrophobic silica can be prepared by affixing a silicone to the surface of the silica, for instance by means of the catalytic reaction disclosed in U.S. Pat. No. 3,235,509, herein incorporated by reference.

Of the above described hydrophobic particulate materials the described ketones and inorganic oxides are preferred. Most preferred are the above described ketones.

Hydrocarbon Polymer

The hydrocarbon polymer is generally described as a viscous polymer being miscible with the carrier materials mentioned above and having low solubility in water. As the viscosities of mixtures of the carrier and the hydrocarbon polymer should be higher than that of the carrier system in the absence of polymer, the polymer should posses a higher viscosity than the carrier. Preferably the polymers posses viscosities higher than 500 mPa.s (as measured at a shear rate of 21 $s^{-1}$). The hydrocarbon polymer is present in the detergent composition in an amount of from 0.01 to 4.0%.

Polymers which are useful in the invention include polyisobutene (PIB) commercially available as Hyvis 200 from British Petroleum; polybutadiene commercially available from Aldrich Chemical Co.; polybutadiene-diol (PBD) commercially available from Aldrich Chemical Co.; polybutadiene, epoxy/hydroxy functionalized commercially available from Aldrich Chemical Co.; polybutadiene, phenyl terminated commercially available from Aldrich Chemical Co.; polycaprolactone-diol commercially available from Aldrich Chemical Co.; polycaprolactone-triol commercially available from Aldrich Chemical Co.

Preferred polymers include poly-isobutene, polybutadiene-diol, and polycaprolactone-triol.

Surfactants

Useful surfactants include anionic, nonionic, cationic, amphoteric, zwitterionic types and mixtures of these surface active agents. Such surfactants are well known in the detergent art and are described at length in "Surface Active Agents and Detergents", Vol. II, by Schwartz, Perry & Birch, Interscience Publishers, Inc. 1959, herein incorporated by reference.

Preferred surfactants are one or a mixture of:

Anionic Surfactants

Anionic synthetic detergents can be broadly described as surface active compounds with one or more negatively charged functional groups. An important class of anionic compounds are the water-soluble salts, particularly the alkali metal salts, of organic sulfur reaction products having in their molecular structure an alkyl radical containing from about 6 to 24 carbon atoms and a radical selected from the group consisting of sulfonic and sulfuric acid ester radicals.

Primary Alkyl Sulfates $$R^1OSO_3M$$

where $R^1$ is a primary alkyl group of 8 to 18 carbon atoms and M is a solubilizing cation. The alkyl group $R^1$ may have a mixture of chain lengths. It is preferred that at least two thirds of the $R^1$ alkyl groups have a chain length of 8 to 14 carbon atoms. This will be the case if $R^1$ is coconut alkyl, for example. The solubilizing cation may be a range of cations which are in general monovalent and confer water solubility. Alkali metal, notably sodium, is especially envisaged. Other possibilities are ammonium and substituted ammonium, such as trialkanolammonium.

Alkyl Ether Sulfates $$R^1O(CH_2CH_2O)_nSO_3M$$

where $R^1$ is a primary alkyl group of 8 to 18 carbon atoms, n has an average value in the range from 1 to 6 and M is a solubilizing cation. The alkyl group $R^1$ may have a mixture of chain lengths. It is preferred that at least two thirds of the $R^1$ alkyl groups have a chain length of 8 to 14 carbon atoms. This will be the case if $R^1$ is coconut alkyl, for example. Preferably n has an average value of 2 to 5.

Fatty Acid Ester Sulfonates $$R^2CH(SO_3M)CO_2R^3$$

where $R^2$ is an alkyl group of 6 to 16 atoms, $R^3$ is an alkyl group of 1 to 4 carbon atoms and M is a solubilizing cation. The group $R^2$ may have a mixture of chain lengths. Preferably at least two thirds of these groups have 6 to 12 carbon atoms. This will be the case when the moiety $R^2CH(—)CO_2(—)$ is derived from a coconut source, for instance. It is preferred that $R^3$ is a straight chain alkyl, notably methyl or ethyl.

Alkyl Benzene Sulfonates $$R^4ArSO_3M$$

where $R^4$ is an alkyl group of 8 to 18 carbon atoms, Ar is a benzene ring ($C_6H_4$) and M is a solubilizing cation. The group $R^4$ may be a mixture of chain lengths. Straight chains of 11 to 14 carbon atoms are preferred.

Particularly preferred anionic surfactants are the fatty acid ester sulfonates with formula:

$$R^2CH(SO_3M)CO_2R^3$$

where the moiety $R^2CH(—)CO_2(—)$ is derived from a coconut source and $R^3$ is either methyl or ethyl.

Nonionic Surfactants

Nonionic surfactants can be broadly defined as surface active compounds with one or more uncharged hydrophilic substituents.

Alkyl Glycosides $$R^5O(R^6O)_n(Z^1)_p$$

wherein $R^5$ is a monovalent organic radical (e.g., a monovalent saturated aliphatic, unsaturated aliphatic or aromatic radical such as alkyl, hydroxyalkyl, alkenyl, hydroxyalkenyl, aryl, alkylaryl, hydroxyalkylaryl, arylalkyl, alkenylaryl, arylalkenyl, etc.) containing from about 6 to about 30 (preferably from about 8 to 18 and more preferably from about 9 to about 13) carbon atoms; $R^6$ is a divalent hydrocarbon radical containing from 2 to about 4 carbon atoms such as ethylene, propylene or butylene (most preferably the unit $(R^6O)_n$ represents repeating units of ethylene oxide, propylene oxide and/or random or block combinations thereof); n is a number having an average value of from 0 to about 12; $Z^1$ represents a moiety derived from a reducing saccharide containing 5 or 6 carbon atoms (most preferably a glucose unit); and p is a number having an average value of from 0.5 to about 10 preferably from about 0.5 to about 5.

Examples of commercially available materials from Henkel Kommanditgesellschaft Aktien of Dusseldorf, Germany include APG® 300, 325 and 350 with $R^4$ being $C_9$–$C_{11}$, n is 0 and p is 1.3, 1.6 and 1.8–2.2 respectively; APG® 500 and 550 with $R^4$ is $C_{12}$–$C_{13}$, n is 0 and p is 1.3 and 1.8–2.2, respectively; and APG® 600 with $R^4$ being $C_{12}$–$C_{14}$, n is 0 and p is 1.3.

While esters of glucose are contemplated especially, it is envisaged that corresponding materials based on other reducing sugars, such as galactose and mannose are also suitable.

Ethoxylated Fatty Alcohols

Ethoxylated fatty alcohols may be used alone or in admixture with anionic surfactants, especially the preferred surfactants above. However, if it is used alone than the fatty alcohol must be of limited chain length so that average chain lengths of the alkyl group $R^7$ in the general formula:

$$R^7O(CH_2CH_2O)_nH$$

is from 6 to 12 carbon atoms. This is preferred in any event, and especially preferred if the weight of anionic surfactant is less than half the weight of ethoxylated fatty alcohol. Notably the group R may have chain lengths in a range from 9 to 11 carbon atoms.

An ethoxylated fatty alcohol normally is a mixture of molecules with different numbers of ethylene oxide residues. Their average number, n, together with the alkyl chain length, determines whether the ethoxylated fatty alcohol has a hydrophobic character (low HLB value) or a hydrophilic character (high HLB value). Preferably, the HLB value should be 10.5 or greater. This requires the average value of n to be at least 4, and possibly higher. The numbers of ethylene oxide residues may be a statistical distribution around the average value. However, as is known, the distribution can be affected by the manufacturing process or altered by fractionation after ethoxylation. Particularly preferred ethoxylated fatty alcohols have a group R which has 9 to 11 carbon atoms while n is from 5 to 8.

Most preferred surfactants are the fatty acid ester sulfonates with formula:

$$R^2CH(SO_3M)CO_2R^3$$

where the moiety $R^2CH(—)CO_2(—)$ is derived from a coconut source and $R^3$ is either methyl or ethyl.

The amount of glycoside surfactant, anionic surfactant and/or ethoxylated fatty alcohol surfactant will be from 0.5 to 40% by weight of the composition. Desirably the total amount of surfactant lies in the same range. The preferred range of surfactant is from 0.5 to 30% by weight, more preferably from 0.5 to 15% by weight.

Enzymes

Proteases capable of facilitating the removal of proteinaceous soils from a substrate are also present in the invention in an amount of from 0.1 to 10 weight percent, preferably 1 to about 5 weight percent. Such proteases include Alcalase®, Relase®, Savinase® and Esperase® from Novo Industries A/S, Maxacale® from Gist-Brocades/IBIS, and Opticlean from MKC.

The compositions may also contain amylases (e.g., Termamyl® and Duramyl® from Novo Industries A/S and lipases (e.g. Lipolase® from Novo Industries A/S).

Bleaching Agents

A wide variety of halogen and peroxygen bleach sources may be used in the present invention. Examples of such halogen and peroxygen bleaches are described in U.S. Pat. No. 5,200,236 issued to Lang et al., herein incorporated by reference.

Among suitable reactive chlorine or bromine oxidizing materials are heterocyclic N-bromo and N-chloro imides such as trichloroisocyanuric, tribromoisocyanuric, dibromoisocyanuric and dichloroisocyanuric acids, and salts thereof with water-solubilizing cations such as potassium and sodium. Hydantoin compounds such as 1,3-dichloro-5, 5-dimethylhydantoin are also quite suitable.

Dry, particular, water-soluble anhydrous inorganic salts are like wise suitable for use herein such as lithium, sodium or calcium hypochlorite and hypobromite. Chlorinated trisodium phosphate is another core material. Chloroisocyanurates are, however, the preferred halogen bleaching agents. Potassium dichloroisocyanurate is supplied by Monsanto Company as ACL-59®. Sodium dichloroisocyanurates are also available from Monsanto as ACL-60®, and in the dihydrate form, from the Olin Corporation as Clearon CDB-56®.

The oxygen bleaching agents of the compositions also include organic peroxy acids and diacylperoxides. Typical monoperoxy acids useful herein include alkyl peroxy acids and aryl peroxy acids such as:

(i) peroxybenzoic acid and ring-substituted peroxybenzoic acids, e.g., peroxy-alpha-naphthoic acid, and magnesium monoperphthalate (ii) aliphatic and substituted aliphatic monoperoxy acids, e.g., peroxylauric acid, peroxystearic acid, epsilon-phthalimido peroxyhexanoic acid and o-carboxybenzamido peroxyhexanoic acid, N-nonenylamidoperadipic acid and N-nonenylamidopersuccinic acid.

Typical diperoxy acids useful herein include alkyl diperoxy acids and aryldiperoxy acids, such as:

(iii) 1,12-diperoxydodecanedioic acid (iv) 1,9-diperoxyazelaic acid (v) diperoxybrassylic acid; diperoxysebacic acid and diperoxy-isophthalic acid (vi) 2-decyldiperoxybutane-1,4-dioic acid (vii) N,N'-terephthaloyl-di(6-aminopercaproic acid).

A typical diacylperoxide useful herein includes dibenzoylperoxide.

Inorganic peroxygen compounds are also suitable for the present invention. Examples of these materials useful in the invention are salts of monopersulfate, perborate monohydrate, perborate tetrahydrate, and percarbonate.

Preferred oxygen bleaching agents include epsilon-phthalimido-peroxyhexanoic acid, o-carboxybenzamidoperoxyhexanoic acid, and mixtures thereof.

The oxygen bleaching agent is present in the composition in an amount of from about 1 to 30 weight percent, preferably 1 to 20 weight percent, most preferably 2 to 15 weight percent.

The oxygen bleaching agent may be incorporated directly into the formulation or may be encapsulated by any number of encapsulation techniques known in the art to produce stable capsules in alkaline liquid formulations.

A preferred encapsulation method is described in U.S. Pat. No. 5,200,236 issued to Lang et al., herein incorporated by reference. In the patented method, the bleaching agent is encapsulated as a core in a paraffin wax material having a melting point from about 40° C. to about 50° C. The wax coating has a thickness of from 100 to 1500 microns.

Bleach Precursors

Suitable peroxygen peracid precursors for peroxy bleach compounds have been amply described in the literature, including GB Nos. 836,988; 855,735; 907,356; 907,358; 907,950; 1,003,310 and 1,246,339; U.S. Pat. Nos. 3,332,882 and 4,128,494.

Typical examples of precursors are polyacylated alkylene diamines, such as N,N,N',N'-tetraacetylethylene diamine (TAED) and N,N,N',N'-tetraacetylmethylene diamine (TAMD); acylated glycolurils, such as tetraacetylglycoluril (TAGU); triacetylcyanurate, sodium sulphophyl ethyl carbonic acid ester, sodium acetyloxybenzene sulfonate (SABS), sodium nonanoyloxy benzene sulfonate (SNOBS) and choline sulfophenyl carbonate. Peroxybenzoic acid precursors are known in the art, e.g., as described in GB-A-836,988. Examples of suitable precursors are phenylbenzoate; phenyl p-nitrobenzoate; o-nitrophenyl benzoate; o-carboxyphenyl benzoate; p-bromo-phenylbenzoate; sodium or potassium benzoyloxy benzene-sulfonate; and benzoic anhydride.

Preferred peroxygen bleach precursors are sodium p-benzoyloxybenzene sulfonate, N,N,N',N'-tetraacetylethylene diamine, sodium nonanoyloxybenzene sulfonate and choline sulfophenyl carbonate.

Detergent Builder Materials

The compositions of this invention can contain all manner of detergent builders commonly taught for use in automatic dishwashing or other cleaning compositions. The builders can include any of the conventional inorganic and organic water-soluble builder salts, or mixtures thereof and may comprise 1 to 75%, and preferably, from about 5 to about 70% by weight of the cleaning composition.

Typical examples of phosphorus-containing inorganic builders, when present, include the water-soluble salts, especially alkali metal pyrophosphates, orthophosphates and polyphosphates. Specific examples of inorganic phosphate builders include sodium and potassium tripolyphosphates, phosphates, pyrophosphates and hexametaphosphates.

Suitable examples of non-phosphorus-containing inorganic builders, when present, include water-soluble alkali metal carbonates, bicarbonates, sesquicarbonates, borates, silicates, metasilicates, and crystalline and amorphous aluminosilicates. Specific examples include sodium carbonate (with or without calcite seeds), potassium carbonate, sodium and potassium bicarbonates, silicates and zeolites.

Particularly preferred inorganic builders can be selected from the group consisting of sodium tripolyphosphate, potassium tripolyphosphate, potassium pyrophosphate, sodium carbonate, potassium carbonate, sodium bicarbonate, sodium silicate and mixtures thereof. When present in these compositions, sodium tripolyphosphate concentrations will range from about 2% to about 40%; preferably from about 5% to about 30%. Potassium tripolyphosphate concentrations will range from about 2% to about 50%, preferably from about 5% to about 40%. Sodium carbonate and bicarbonate when present can range from about 5% to about 50%; preferably from about 10% to about 30% by weight of the cleaning compositions. Sodium tripolyphosphate, potassium tripolyphosphate, and potassium pyrophosphate can be used as builders in gel formulations, where they may be present from about 3 to about 50%, preferably from about 10 to about 35%.

Organic detergent builders can also be used in the present invention. Examples of organic builders include alkali metal citrates, succinates, malonates, fatty acid sulfonates, fatty acid carboxylates, nitrilotriacetates, phytates, phosphonates, alkanehydroxyphosphonates, oxydisuccinates, alkyl and alkenyl disuccinates, oxydiacetates, carboxymethyloxy succinates, ethylenediamine tetraacetates, tartrate monosuccinates, tartrate disuccinates, tartrate monoacetates, tartrate diacetates, oxidized starches, oxidized heteropolymeric polysaccharides, polyhydroxysulfonates, polycarboxylates such as polyacrylates, polymaleates, polyacetates, polyhydroxyacrylates, polyacrylate/polymaleate and polyacrylate/polymethacrylate copolymers, acrylate/maleate/vinyl alcohol terpolymers, aminopolycarboxylates and polyacetal carboxylates, and mixtures thereof. Such carboxylates are described in U.S. Pat. Nos. 4,144,226 and 4,146,495.

Alkali metal citrates, oxydisuccinates, polyphosphonates and acrylate/maleate copolymers and acrylate/maleate/vinyl alcohol terpolymers are especially preferred organic builders. When present they are preferably available from about 1% to about 35% of the total weight of the detergent compositions.

The foregoing detergent builders are meant to illustrate but not limit the types of builders that can be employed in the present invention.

Alkalinity

The alkalinity of an aqueous solution for the composition of the invention should be less than about 11, preferably about 5 to about 10, most preferably about 7 to about 9. Buffering agent materials should be present in the invention in an amount of from about 1 to about 30 weight %, preferably from 5 to about 25 weight % of the total composition. Any number of conventional buffer agents may be used to maintain the desired pH range. Such materials can include, for example, various water soluble inorganic salts such as carbonates, bicarbonates, sesquicarbonates, silicates, phosphates, tetraborates and mixtures thereof.

If silicates are present in the compositions of the invention, the preferred amounts are from about 1 to about 20%. Especially preferred is sodium silicate in a ratio of $SiO_2$:$Na_2O$ up from about 1.0 to about 3.3, preferably from about 2 to about 3.2. Insoluble silica such as described in Gordon et al., U.S. Ser. No. 08/496,348 herein incorporated by reference may be incorporated as a decor care ingredient and glass anticorrosion agent.

Filler

An inert particulate filler material which is water-soluble may also be present in cleaning compositions. This material should not precipitate calcium or magnesium ions at the filler use level. Suitable for this purpose are organic or inorganic compounds. Organic fillers include sucrose esters and urea. Representative inorganic fillers include sodium sulfate, sodium chloride and potassium chloride. A preferred filler is sodium sulfate. Its concentration may range from 0% to 60%, preferably from about 10% to about 30% by weight of the cleaning composition.

Thickeners and Stabilizers

Thickeners are often desirable for liquid cleaning compositions. Thixotropic thickeners such as smectite clays including montmorillonite (bentonite), hectorite, saponite, and the like may be used to impart viscosity to liquid cleaning compositions. Silica, silica gel, and aluminosilicate may also be used as thickeners. Salts of polyacrylic acid (of molecular weight of from about 300,000 up to 6 million and higher), including polymers which are cross-linked may also be used alone or in combination with other thickeners. Use of clay thickeners for automatic dishwashing compositions is disclosed for example in U.S. Pat. Nos. 4,431,559; 4,511,487; 4,740,327; 4,752,409. Commercially available synthetic smectite clays include Laponite supplied by Laporte Industries. Commercially available bentonite clays include Korthix H and VWH ex Combustion Engineering, Inc.; Polargel T ex American Colloid Co.; and Gelwhite clays (particularly Gelwhite GP and H) ex English China Clay Co. Polargel T is preferred as imparting a more intense white appearance to the composition than other clays. The amount of clay thickener employed in the compositions is from 0.1 to about 10%, preferably 0.5 to 5%. Use of salts of polymeric carboxylic acids is disclosed for example in UK Patent Application GB 2,164,350A, U.S. Pat. No. 4,859,358 and U.S. Pat. No. 4,836,948.

For liquid formulations with a "gel" appearance and rheology, particularly if a clear gel is desired, a chlorine-resistant polymeric thickener is particularly useful. U.S. Pat. No. 4,260,528 discloses natural gums and resins for use in clear autodish detergents, which are not chlorine stable. Acrylic acid polymers that are cross-linked manufactured by, for example, B. F. Goodrich and sold under the trade name "Carbopol" have been found to be effective for production of clear gels, and Carbopol 940, 617 and 627, having a molecular weight of about 4,000,000 is particularly preferred for maintaining high viscosity with excellent chlorine stability over extended periods. Further suitable chlorine-resistant polymeric thickeners are described in U.S. Pat. No. 4,867,896 incorporated by reference herein.

The amount of thickener employed in the compositions is from 0 to 5%, preferably 0.5–3%.

Stabilizers and/or co-structurants such as long-chain calcium and sodium soaps and $C_{12}$ to $C_{18}$ sulfates are detailed in U.S. Pat. Nos. 3,956,158 and 4,271,030 and the use of other metal salts of long-chain soaps is detailed in U.S. Pat. No. 4,752,409. Other co-structurants include Laponite and metal oxides and their salts as described in U.S. Pat. No. 4,933,101, herein incorporated by reference. The amount of stabilizer which may be used in the liquid cleaning compositions is from about 0.01 to about 5% by weight of the composition, preferably 0.01–2%. Such stabilizers are optional in gel formulations. Co-structurants which are found especially suitable for gels include trivalent metal ions at 0.01–4% of the compositions, Laponite and/or water-soluble structuring chelants at 1–60%. These co-structurants are more fully described in the U.S. Pat. No. 5,141,664 by Corring et al., hereby incorporated by reference.

Anti-Tarnishing Agents

Anti-tarnishing agents may be incorporated into the compositions. Such agents include benzotriazole, certain 1,3 N-azoles described in U.S. Pat. No. 5,480,576 to Gary et al.; isocyanuric acid described in U.S. Pat. No. 5,374,369 by Angevaare et al.; and purine compounds described in U.S. Pat. No. 5,468,410 herein incorporated by reference.

The following examples will serve to distinguish this invention from the prior art and illustrate its embodiments more fully. Unless otherwise indicated, all parts, percentages and proportions referred to are by weights.

EXAMPLE 1

The foam behavior of surfactants in the automatic dishwasher was investigated by monitoring the pressure of the water circulating pump during the main wash stage of a dishwash cycle. All experiments were carried out in a 5 liter Bosch SMS 6082 automatic dishwashing machine that had been adapted to allow pump pressure monitoring. The rapid program of the dishwasher, consisting of a main wash (heated to 50° C.), two cold rinses, a final rinse (heated to 65° C.) and a drying step, was used for these experiments. To allow pressure monitoring, a pressure transducer (ex. Omega Engineering Inc., Connecticut) was installed in the dishwasher.

Table 1 shows the base dishwashing composition used for this example.

TABLE 1

| Ingredient | % by weight |
|---|---|
| Sodium citrate (as .2$H_2O$) | 51 |
| Sokalan CP5[1] | 5 |
| Sokalan PA25[2] | 2.5 |
| Sodium bicarbonate | 39 |
| Silicate 2.8[3] | 2.5 |

[1]An acrylic acid/maleic acid copolymer supplied by BASF Corporation, New Jersey.
[2]A polyacrylic acid, sodium salt supplied by BASF Corporation, New Jersey.
[3]Supplied by The PQ Corporation, Pennsylvania.

Foam generation by a surfactant, either anionic or nonionic, when added on top of 16.5 g of this base composition was determined by monitoring the pump pressure. Soft water (water hardness<10 ppm) was used. The pump pressures are shown in Table 2. These pressures are calculated averages, as measured during the main wash, and are expressed as a percentage of the average pressure obtained in the absence of a surfactant.

TABLE 2

| Surfactant | Average Pump Pressure (%) |
|---|---|
| None | 100 |
| 0.08 mM Stepanol[4] | 95 |
| 0.1 mM Stepanol | 77 |
| 0.12 mM Stepanol | 65 |
| 0.14 mM Stepanol | 55 |
| 0.1 mM APG[5] | 100 |
| 0.2 mM APG | 80 |
| 0.3 mM APG | 50 |
| 0.1 mM Alphastep[6] | 100 |
| 0.25 mM Alphastep | 78 |
| 0.5 mM Alphastep | 56 |

[4]Stepanol WA-Extra, a primary alkyl sulfate supplied by Stepan Chemicals, Illinois.
[5]APG 325CS, an alkyl polyglycoside supplied by Henkel Corporation, Pennsylvania.
[6]Alphastep ML40, a fatty acid ester sulfonate supplied by Stepan Chemicals, Illinois.

Table 2 shows that even low surfactant levels can cause significant pump pressure drops. Without being limited to theory, it is believed that this pump pressure drop is caused by air drawn into the pump of the automatic dishwasher as a result of foam formation.

Again without being limited to theory, foam is thought to reduce the mechanical impact of the wash liquor onto the dishware, thereby compromising on cleaning performance. Furthermore, foam can interfere with the supply of water to the heating element of the dishwasher, which could eventually wreck the heating element, Excessive foam formation can also lead to air locking of the water circulating pump, eventually destroying the pump.

Table 2 also shows the benefit of the fatty acid ester sulfonate Alphastep ML40, being a low-foaming anionic surfactant. Since the average pump pressure as a function of concentration does not drop as steeply as with both other surfactants shown in Table 2, higher concentrations of the fatty acid ester sulfonate can be tolerated in the. dishwashing machine.

Table 3 shows the effect of anionic surfactant concentration on the removal of soil from glass slides. New glass slides (50×50×1 mm) were machine washed and repeatedly rinsed with deionized water and subsequently soiled with about 200 mg baked-on egg-yolk per slide. The base composition for these soil removal experiments consisted of 2.04 g sodium citrate (as 0.2$H_2O$), 0.34 g Sokalan CP7 (as 40% solution), 0.20 g sodium tetraborate, and 0.40 g glycerol. These ingredients were added to 1 liter 250 ppm hardness (Ca:Mg=4:1) water and stirred at 55° C. for 10 minutes, after which the pH was adjusted to 8 using $H_2SO_4$ and NaOH. The solutions then received 109 kGU Alcalase 2.5 L (Novo Nordisk, Denmark) and an anionic surfactant according to the levels shown in Table 3. The solutions were maintained at 55° C. After one minute, the soiled glass slides were placed in the solution. The slides were removed after 30 minutes, dried and weighed to determine soil removal. The quantity removed was expressed as a percentage of the original soil.

Results were as follows:

TABLE 3

| Surfactant | w % Egg-yolk Removal |
|---|---|
| none | 11 |
| 0.25 mM Stepanol | 35 |
| 0.5 mM Stepanol | 52 |
| 1.0 mM Stepanol | 54 |
| 1.5 mM Stepanol | 55 |
| 0.25 mM Alphastep | 27 |
| 0.5 mM Alphastep | 42 |
| 1.0 mM Alphastep | 51 |
| 1.5 mM Alphastep | 62 |
| 2.0 mM Alphastep | 65 |

Combining Tables 2 and 3 of this example teaches that optimum soil removal benefits from anionic surfactants are obtained at surfactant concentrations that are too high to be applied without a foam controlling agent. A significant consideration while formulating an automatic dishwashing composition containing a relatively high surfactant level is therefore to suppress foaming.

EXAMPLE 2

This example demonstrates the anti-foam action of Dehypon 2429, a commercially available anti-foam containing 5–15% of the long-chain ketone type. The effect of its level on the average pump pressure was determined using 34 g of the base dishwashing composition shown in Table 4. Water with hardness 250 ppm (Ca:Mg=4:1) was used.

TABLE 4

| Ingredient | % by weight |
|---|---|
| Sodium citrate (as .2$H_2O$) | 30 |
| Sokalan CP7[7] (as 40% solution) | 5 |
| Cross-linked acrylic polymer[8] | 1.5 |
| Glycerol | 6 |
| Sodium tetraborate | 3 |
| Alphastep | 6.6 |
| Water | to balance |

[7]An acrylic acid/maleic acid copolymer supplied by BASF Corporation, New Jersey.
[8]A high molecular weight polymer having a molecular weight of about one million, supplied as Carbopol 627 by B. F. Goodrich, Ohio.

The procedure to determine pump pressure was similar to Example 1. The pump pressures are shown in Table 5.

TABLE 5

| Dehypon[9] Concentration (ppm) | Average Pump Pmssure (%) |
|---|---|
| 10 | 51 |
| 25 | 62 |

TABLE 5-continued

| Dehypon[9] Concentration (ppm) | Average Pump Pmssure (%) |
|---|---|
| 50 | 69 |
| 100 | 76 |
| 200 | 82 |

[9]Dehypon 2429, a long-chain ketone in a fatty alcohol carrier supplied by Henkel, Germany. This material contains 5–15% long-chain ketones.

The data shown in Table 5 indicates that the pump pressure losses are significant, even with systems containing a Dehypon concentration as high as 200 ppm in the main wash. The relative low averages are caused primarily by pronounced pressure fluctuations at the latter portion of the main wash. These fluctuations are indicative of increasing foam levels towards the end of the wash. Although the ketone/carrier anti-foam works effectively at the beginning of the washing cycle, the anti-foam effectiveness diminishes significantly towards the latter portion of the wash. Without being limited to theory, disproportionation during the wash of the carrier droplets in which the ketones reside is thought to cause this effectiveness drop.

Since these experiments were conducted under soil-free conditions and since especially proteinaceous soils are known to cause additional foaming, the effectiveness of this ketone/carrier anti-foam system was considered to be inadequate. Therefore, improvement was sought by reducing droplet disproportionation. Increasing the viscosity of the carrier system was therefore thought to be the key to improved anti-foam effectiveness.

EXAMPLE 3

This example demonstrates that mixing the ketone/carrier anti-foam system with a viscous hydrocarbon polymer increases both the viscosity and the effectiveness of the anti-foam system. The viscosities of mixtures of a ketone/carrier anti-foam, i.e. Dehypon 2429, with various polymers at a shear rate of 21 $s^{-1}$ are shown in Table 6. The viscosities were measured using a Haake Rotovisco viscometer, operating at a temperature of 20° C.

TABLE 6

| w % Polymer in Dehypon 2429 | Viscosity at 21 $s^{-1}$ (mPa · s) | Average Pump Pressure (%) |
|---|---|---|
| none (Control) | 301 | 64 |
| 1% PBD-1[10] | 305 | — |
| 2% PBD-1 | 322 | — |
| 5% PBD-1 | 355 | 78 |
| 10% PBD-1 | 410 | 85 |
| 25% PBD-1 | 581 | 94 |
| 50% PBD-1 | 1,162 | 100 |
| 5% PBD-2[11] | 331 | — |
| 10% PBD-2 | 363 | 65 |
| 25% PBD-2 | 468 | 78 |
| 50% PBD-2 | 677 | — |
| 5% PIB[12] | 339 | 71 |
| 25% PIB | 808 | 89 |
| 50% PIB | 2,557 | — |
| 5% PCT[13] | 308 | — |
| 25% PCT | | 74 |
| 5% PB[14] | 355 | — |
| 25% PB | 726 | 89 |

[10]Polybutadiene-diol supplied by Aldrich Chemical Co., Milwaukee; Average $M_n$ ca. 2,800.
[11]Polybutadiene-diol supplied by Aldrich Chemical Co., Milwaukee; Average $M_n$ ca. 1,200; Viscosity 1,900 mPa · s.
[12]Poly-isobutene as Hyvis 200 supplied by British Petroleum.

TABLE 6-continued

| w % Polymer in Dehypon 2429 | Viscosity at 21 $s^{-1}$ (mPa · s) | Average Pump Pressure (%) |
|---|---|---|

[13]Polycaprolactone-triol supplied by Aldrich Chemical Co., Milwaukee; $M_w$ ca. 900.
[14]Polybutadiene supplied by Aldrich Chemical Co., Milwaukee; Average $M_n$ ca. 5,000.

Some of the mixtures of which the viscosities are shown in Table 6 were also used for pump pressure experiments in the dishwashing machine. Compositions were prepared as described in Table 1 except an amount of 6.8 g Alphastep ML-40 and an anti-foam mixture were added to this base composition. Anti-foam mixtures were dosed at amounts delivering a concentration of 50 ppm Dehypon 2429 in the main wash. Soft water (water hardness<10 ppm) was used, no soils were present in the dishwasher. The procedure to determine pump pressure was similar to Example 1. The average pump pressures are shown in Table 6. It was thus observed that incorporation of viscous hydrocarbon polymers into the ketone/carrier system improves anti-foam effectiveness.

Under the same conditions, experiments were conducted using hydrocarbon polymers as sole anti-foaming agent. The polymers were dosed at amounts delivering a concentration of 50 ppm in the main wash. Table 7 shows that the polymers provide some anti-foam action. Their effectiveness in the absence of the long-chain ketones, however, is unacceptably low. The effect of combining a viscous hydrocarbon polymer and a long-chain ketone is thus synergistic.

Compared with the Control (50 ppm Dehypon 2429), pump pressure profiles of the mixtures show primarily higher and more stable pump pressures at the end of the main wash, presumably due to a droplet stabilization effect.

TABLE 7

| Polymer | Average Pump Pressure (%) |
|---|---|
| PBD-1 | 51 |
| PIB | 37 |
| PB | 37 |

EXAMPLE 4

This example demonstrates the improvement in anti-foam performance when a long-chain ketone is combined with a viscous hydrocarbon polymer.

The procedure to determine pump pressure was similar to Example 1. Soft water 10 ppm) was used for these experiments, no soils were present in the dishwasher.

Compositions were prepared as described in Table 1 except an amount of surfactant and an amount of anti-foam components was added to 16.5 g of this base composition to deliver the concentrations of active material corresponding to the data in Table 8.

TABLE 8

| Surfactant | Anti-foam System | Average Pump Pressure (%) |
|---|---|---|
| 0.25 mM Stepanol[15] | 50 ppm Dehypon 2429 | 81 |
| 0.25 mM Stepanol | 50 ppm Dehypon 2429<br>12.5 ppm PBD-1 | 94 |
| 0.5 mM APG[16] | 50 ppm Dehypon 2429 | 83 |

TABLE 8-continued

| Surfactant | Anti-foam System | Average Pump Pressure (%) |
|---|---|---|
| 0.5 mM APG | 50 ppm Dehypon 2429<br>12.5 ppm PBD-1 | 87 |
| 1.5 mM Alphastep[17] | 50 ppm Dehypon 2429 | 64 |
| 1.5 mM Alphastep | 50 ppm Dehypon 2429<br>12.5 ppm PBD-1 | 94 |

[15]Stepanol WA-Extra, a primary alkyl sulfate supplied by Stepan Chemicals, Illinois.
[16]APG 325CS, an alkyl polyglycoside supplied by Henkel Corporation, Pennsylvania.
[17]Alphastep ML40, a fatty acid ester sulfonate supplied by Stepan Chemicals, Illinois.

It was thus observed that adding a viscous hydrocarbon polymer to a long-chain ketone containing carrier material improves anti-foam performance. The improved anti-foam performance results in reduced foam formation by various surfactants, both anionics and nonionic.

EXAMPLE 5

This example demonstrates the anti-foam effectiveness of a number of hydrophobic particles in mixtures with the viscous polymeric carrier. Compositions were prepared as described in Table 1 except an amount of 6.8 g alphastep ML-40 and an anti-foam mixture were added to this base composition. Anti-foam mixtures were dosed at amounts delivering a concentration of 45 ppm carrier fluid and 5 ppm hydrophobic particulates in the main wash. Soft water (water hardness 10 ppm) was used, no soils were present in the dishwasher. The procedure to determine pump pressure was similar to Example 1. The observed average pump pressures are shown in Table 9.

TABLE 9

| Hydrophobic Particulate | Carrier Fluid | Average Pump Pressure (%) |
|---|---|---|
| Cab-O-Sil TS-610[18] | Minerai Oil[19] | 71 |
| Cab-O-Sil TS-720[20] | Mineral Oil | 81 |
| Cab-O-Sil TS-530[21] | Mineral Oil | 89 |
| Calcium Oleate[22] | Mineral Oil | 68 |
| Cab-O-Sil TS-610 | Mineral Oil/PBD1[23]<br>(ratio 1:3) | 76 |
| Cab-O-Sil TS-610 | Mineral Oil/PBD-1<br>(ratio 1:9) | 100 |
| Cab-O-Sil TS-610 | PBD-1 | 100 |
| Cab-O-Sil TS-720 | PBD-1 | 91 |
| Cab-O-Sil TS-530 | PBD-1 | 100 |
| Calcium Oleate | PBD-1 | 94 |

[18]A fumed silica treated with dimethyldichlorosilane, which replaces surface hydroxyl groups with methyl groups, supplied by the Cabot Corporation, Illinois.
[19]A mineral oil with d = 0.88 g/ml and viscosity (100° F.): 340–360 Saybolt Universal Seconds, supplied by Sigma Diagnostics, Missouri.
[20]A fumed silica chemically reacted with a silicone fluid, supplied by the Cabot Corporation, Illinois.
[21]A fumed silica treated with hexamethyldisilazane, leaving trimethylsilyl groups at the silica surface, supplied by the Cabot Corporation, Illinois.
[22]Calcium oleate particulates were prepared by adding an aqueous solution of potassium oleate droplet-wise into a continuously mixing food blender containing a 8.2 mM solution of calcium chloride. After rinsing the Ca-oleate layer twice with deionized water, the material was freeze-dried. This procedure resulted in a very fine dry powder, with Ca-oleate particle size of ranging from about 1 to about 400 microns.
[23]Polybutadiene-diol supplied by Aldrich Chemical Co., Milwaukee; Average $M_n$ ca. 2,800.

It was thus observed that an anti-foam system consisting of a hydrophobic particulate mixed with a carrier fluid containing a viscous hydrophobic polymer provides better foam control than a similar system in which a mineral oil is the sole carrier fluid. It was also observed that a variety of hydrophobic particulates can be used to prepare an effective anti-foam system under machine dishwashing conditions.

What is claimed:

1. An automatic dishwashing composition which substantially inhibits foam production in a dishwasher comprising:
   a) an anti-foam system comprising
      (i) 0.01 to 1% by wt. of the total dishwashing composition of a hydrophobic particulate solid material selected from the group consisting of an ester of a fatty acid having $C_{12}$ to $C_{22}$ carbons and water insoluble salts thereof, a water insoluble salt of an alkylphosphate having from a $C_8$ to $C_{22}$ straight or branched carbon chain, a hydrophobically modified inorganic oxide, and a ketone having at least 25 carbon atoms and
      (ii) 0.01 to 4% of the total dishwashing composition of a viscous hydrocarbon polymer having a viscosity greater than 500 mPa.s as measured at a shear rate of 21 $sec^{-1}$, wherein the ratio of the hydrophobic particulate solid material to the hydrocarbon polymer is from 10:1 to 1:20;
   b) 0.5 to 40 wt. % of a surfactant selected from the group consisting of:
      (i) an anionic surfactant with a hydrophilic head group which is, or which contains a sulfate or sulfonate group and a hydrophobic portion which is or which contains an alkyl or alkenyl group of 6 to 24 carbon atoms,
      (ii) an alkyl glycoside
      (iii) an ethoxylated fatty alcohol of formula $$RO(CH_2CH_2O)_nM$$

wherein R is an alkyl group of 6 to 16 carbon atoms and n has an average value which is at least four and is sufficiently high that the HLB of the ethoxylated fatty alcohol is 10.5 or greater;
   c) 0.1 to 10 wt. % of an enzyme;
   d) 1 to 30 wt. % of a bleaching agent selected from a group of a peroxygen agent, a hypohalite agent and its corresponding salts and its mixtures thereof;
   e) 1 to 75 wt. % of a builder; and
   f) about 1 to about 30 wt. % of a buffer, the composition having a pH of less than about 11.

2. A composition according to claim 1 wherein the ketone is obtained by the ketonization of $C_{16}$–$C_{22}$ carboxylic acids, carboxylic acid salts and mixtures thereof.

3. A composition according to claim 2 wherein the ketone is selected from the group consisting of heptacosanone-14, hentriacontanone-16, pentatriacontanone-18, nonatriacontanone-20, triatetracontanone-22 or nonacossanone-15, tri-triacontanone-17, heptatriacontanone-19, hentetracontanone-21 and mixtures thereof.

4. A composition according to claim 1 wherein the fatty acids are either saturated or unsaturated.

5. A composition according to claim 4 wherein the fatty acids are selected from the group consisting of palmitic acid, palmitoleic acid, oleic acid, stearic acid and linoleic acid.

6. A composition according to claim 1 wherein the water insoluble salts of the fatty acids are selected from the group consisting of calcium, magnesium, zinc, aluminum, and mixtures thereof.

7. A composition according to claim 1 wherein the viscous hydrocarbon polymer is selected from the group consisting poly-isobutene, polybutadiene, polybutadiene-diol, polybutadiene epoxy/hydroxy functionalized, polybutadiene phenyl terminated, polycaprolactone-diol, polycaprolactone-triol and mixtures thereof.

8. A composition according to claim 7 wherein the polymer is poly-isobutene, polybutadiene, polybutadiene-diol, polycaprolactone-triol and mixtures thereof.

9. A composition according to claim 1 wherein the ratio of the hydrophobic particulate solid material to the hydrocarbon polymer is from 5:1 to 1:10.

10. A composition according to claim 1 wherein the enzyme is selected from the group consisting of protease, amylase, lipase and mixtures thereof.

11. A composition according to claim 1 wherein the anionic surfactant is selected from the group consisting of:

i) a primary alkyl sulfate having a formula $$R^1OSO_3M$$

wherein $R^1$ is a primary alkyl group of 8 to 18 carbon atoms and M is a solubilizing cation, ii) an alkyl ether sulfate having a formula $$R^1O(CH_2CH_2O)_nSO_3M$$

wherein $R^1$ is a primary alkyl group of 8 to 18 carbon atoms, n has an average value in the range from 1 to 6 and M is a solubilizing cation, iii) a fatty acid ester sulfonate having a formula $$R^2CH(SO_3M)CO_2R^3$$

wherein $R^2$ is an alkyl group of 6 to 16 atoms, $R^3$ is an alkyl group of 1 to 4 carbon atoms and M is a solubilizing cation, and iv) an alkyl benzene sulfonate having a formula $$R^4ArSO_3M$$

wherein $R^4$ is an alkyl group of 8 to 18 carbon atoms, Ar is a benzene ring ($C_6H_4$) and M is a solubilizing cation.

12. A composition according to claim 1 wherein the anionic surfactant is a fatty acid ester sulfonate of formula $$R^2CH(SO_3M)CO_2R^3$$

wherein the moiety $R^2CH(—)CO_2(—)$ is derived from a coconut source and $R^3$ is either methyl or ethyl.

13. A composition according to claim 1 wherein the alkyl glycoside is of a formula $$R^5O(R^6O)_n(Z^1)_p$$

wherein $R^5$ is a monovalent organic radical containing from about 6 to about 30 carbon atoms; $R^6$ is a divalent hydrocarbon radical containing from 2 to about 4 carbon atoms; n is a number having an average value of from 0 to about 12; $Z^1$ represents a moiety derived from a reducing saccharide containing 5 or 6 carbon atoms; and p is a number having an average value of from 0.5 to about 10.

14. A composition according to claim 13 wherein group $R^5$ contains from about 8 to 18 carbon atoms.

15. A composition according to claim 13 wherein group $R^5$ contains from about 9 to 13 carbon atoms.

16. A composition according to claim 13 wherein p has an average value of from 0.5 to about 5.

17. A composition according to claim 1 further comprising an anti-tarnishing agent.

18. A method of washing tableware in an automatic dishwashing machine comprising selecting an automatic dishwashing composition comprising:

a) an anti-foam system comprising (i) 0.01 to 1% by wt. of the total dishwashing composition of a hydrophobic particulate solid material selected from the group consisting of an ester of a fatty acid having $C_{12}$ to $C_{22}$ carbons and water insoluble salts thereof, a water insoluble salt of an alkylphosphate having from a $C_8$ to $C_{22}$ straight or branched carbon chain, a hydrophobically modified inorganic oxide and a ketone having at least 25 carbon atoms and (ii) 0.01 to 4% of the total dishwashing composition of a viscous hydrocarbon polymer having a viscosity of a greater than 500 mPa.s as measured at a shear rate of 21 $sec^{-1}$, wherein the ratio of the hydrophobic particulate solid material to the hydrocarbon polymer is from 10:1 to 1:20, b) 0.5 to 40 wt. % of a surfactant selected from the group consisting of:

(i) an anionic surfactant with a hydrophilic head group which is, or which contains a sulfate or sulfonate group and a hydrophobic portion which is or which contains an alkyl or alkenyl group of 6 to 24 carbon atoms, (ii) an alkyl glycoside, (iii) an ethoxylated fatty alcohol of formula $$RO(CH_2CH_2O)_nM$$

wherein R is an alkyl group of 6 to 16 carbon atoms and n has an average value which is at least four and is sufficiently high that the HLB of the ethoxylated fatty alcohol is 10.5 or greater;

c) 0. 1 to 10 wt. % of an enzyme, d) 1 to 30 wt. % of a bleaching agent selected from a group of a peroxygen agent, a hypohalite agent and its corresponding salts and its mixtures thereof, e) 1 to 75 wt. % of a builder, and f) about 1 to about 30 wt. % of a buffer, the composition having a pH of less than about 11, to substantially clean the tableware and to substantially inhibit foam formation.

19. A method according to claim 18 wherein the ketone is obtained by the ketonization of $C_{16}$–$C_{22}$ carboxylic acids, carboxylic acid salts and mixtures thereof.

20. A method according to claim 19 wherein the viscous hydrocarbon polymer is selected from the group consisting poly-isobutene, polybutadiene, polybutadiene-diol, polybutadiene epoxy/hydroxy functionalized, polybutadiene phenyl terminated, polycaprolactone-diol, polycaprolactone-triol and mixtures thereof.

* * * * *